US011383879B2

(12) United States Patent
Kara

(10) Patent No.: US 11,383,879 B2
(45) Date of Patent: Jul. 12, 2022

(54) FOLDING TRANSPORT CONTAINER

(71) Applicant: UNIPAS, SPOL. S.R.O., Kos (SK)

(72) Inventor: Maros Kara, Prievidza (SK)

(73) Assignee: Unipas, Spol S.R.O., Kos (SK)

( * ) Notice: Subject to any disclaimer, the term of this patent is extended or adjusted under 35 U.S.C. 154(b) by 48 days.

(21) Appl. No.: 16/772,319

(22) PCT Filed: Apr. 4, 2019

(86) PCT No.: PCT/SK2019/050003
§ 371 (c)(1),
(2) Date: Jun. 12, 2020

(87) PCT Pub. No.: WO2020/204840
PCT Pub. Date: Oct. 8, 2020

(65) Prior Publication Data

US 2021/0229859 A1 Jul. 29, 2021

(51) Int. Cl.
*B65D 6/26* (2006.01)
*B65D 19/12* (2006.01)
*B65D 88/52* (2006.01)

(52) U.S. Cl.
CPC ..... *B65D 7/30* (2013.01); *B65D 19/12* (2013.01); *B65D 88/522* (2013.01); *B65D 2519/00611* (2013.01); *B65D 2519/00646* (2013.01)

(58) Field of Classification Search
CPC ..... B65G 2201/0235; B65G 69/08; B65G 67/60; B65D 88/12; B65D 85/185;
(Continued)

(56) References Cited

U.S. PATENT DOCUMENTS 1,918,003 A * 7/1933 Brooks ..... B65D 19/0075 108/56.1
2,956,763 A * 10/1960 D Arca ..... B65D 19/12 211/195

(Continued)

FOREIGN PATENT DOCUMENTS

| | | | |
|---|---|---|---|
| AU | 78176/91 | A | 8/1991 |
| DE | 9012818 | U1 | 11/1990 |
| EP | 1918215 | A1 | 5/2008 |

OTHER PUBLICATIONS

International Search Report and Written Opinion dated Nov. 18, 2019 in Corresponding Application PCT/SK2019/050003 (12 pages).

*Primary Examiner* — Kareen K Thomas
(74) *Attorney, Agent, or Firm* — Hovey Williams LLP

(57) ABSTRACT

Folding transport container intended mainly for transport of materials, goods, and other cargo, comprising the base, side panels with side uprights (2, 3), where these panels have pivot links with edges of the base and lock-release mechanism (1). The lock-release mechanism is placed inside the side upright (2) of the first side panel and includes the lever (4) with catch (5) and spring (6), wherein the lever (4) is placed in rotary fashion inside the side upright (2) of the first side panel using fixed axis (7) so that one end of the lever (4) is placed within the hollow 1 (8) of the side upright (2) of the first side panel, while the other end of the lever (2) has fixed link to a catch (5), which is placed inside the hollow 2 (9) of the side upright (2) of the first side panel. The side upright (3) of the adjacent side panel is equipped with an opening (10), whose shape and dimensions are adapted to the shape and dimensions of the catch (5) and it is in one plane with the catch (5). The spring (6) is linked to the lever (4).

9 Claims, 3 Drawing Sheets

(58) Field of Classification Search
CPC ..... B65D 25/101; B65D 2519/00696; B65D 2519/00661; B65D 83/206; B65D 83/201; B65D 7/30; B65D 19/12; B65D 88/522; B65D 2519/00611; B65D 2519/00646; B65D 2519/009
See application file for complete search history.

(56) References Cited

U.S. PATENT DOCUMENTS 3,563,578 A * 2/1971 Meller ..... B65D 88/522 217/12 R
3,735,713 A * 5/1973 Glassmeyer ..... B65D 88/522 108/53.5
4,034,866 A * 7/1977 Beckwith ..... A47B 61/003 211/124
4,357,736 A * 11/1982 Karpisek ..... B65D 19/12 16/263
5,275,301 A * 1/1994 Clive-Smith ..... B65D 88/129 206/504
8,261,924 B2 9/2012 Karpisek
2007/0217883 A1* 9/2007 Heinrichs ..... B65D 19/12 410/80
2014/0263297 A1* 9/2014 Churbuck ..... B65D 88/522 220/1.5
2015/0069051 A1* 3/2015 Kraft ..... B65D 88/522 220/1.5
2015/0108121 A1* 4/2015 Kraft ..... B65D 88/522 220/7
2016/0311613 A1* 10/2016 Churbuck ..... B65D 88/522

* cited by examiner

FOLDING TRANSPORT CONTAINER

RELATED APPLICATIONS

This application is the National Stage of International Patent Application No. PCT/SK2019/050003, filed Apr. 4, 2019, which is hereby incorporated herein by reference in its entirety.

TECHNICAL FIELD

The technical solution relates to folding transport container intended mainly for transport of materials, goods, and other cargo and belongs to the field of transport.

BACKGROUND ART

Presently, large amounts of materials, goods, and other cargo are transported packaged in containers, using waterborne, road, rail, and air transport. It is desired that individual containers are placed immediately next to each other, thereby minimizing the space both during transportation and storage. When storing or transporting empty containers, it is also desired that the volume of space occupied by empty containers is minimized. This can be achieved by folding the containers.

Currently used transport containers are e.g. made of metal profiles with use of plastic or metal walls. The current known state of folding such transport containers is based on use of withdrawable pull rods, which, upon being withdrawn, release part of the upright of the side wall of the container, thereby allowing for folding of the upright or folding of the side wall of the container. A disadvantage of this known solution is that the withdrawable pull rods protrude from the outer walls of the transport container, which makes placing of the transport containers immediately next to or behind each other impossible, increasing the space required for storage or transportation. Another disadvantage is that during manipulation, the withdrawable pull rods get stuck or even destroyed. Their destruction also occurs when placing the containers as close to each other as possible. Another disadvantage of using withdrawable pull rods is the high physical force needed for their withdrawal.

Patent document U.S. Pat. No. 8,261,924 describes collapsible air freight container, which comprises a standard base, a side panel slideably hinged to the base and a back panel which is hinged to the base which interlocks with the side panel. However, this patent document does not solve a construction matter of locking and releasing mechanism of side panels with the back panel.

NATURE OF INVENTION

The aforementioned disadvantages are eliminated by folding transport container intended mainly for transport of materials, goods, and other cargo according to this invention, whose principle is based on folding and unfolding of the transport container provided by an embedded lock-release mechanism according to this invention.

Folding transport container mainly intended for use in transportation of materials, goods, and other cargo includes base, side panels with side uprights, where the side panels have pivot links with edges of the base. The folding transport container also includes a lock-release mechanism located inside the side upright of the first side panel. The lock-release mechanism includes a lever with a catch and a spring. The lever is placed in rotary fashion inside the side upright of the first side panel using fixed axis so that one end of the lever is placed within the hollow 1 of the side upright of the first side panel, while the other end of the lever has fixed link to a catch, which is placed inside the hollow 2 of the side upright of the first side panel. Side upright of the adjacent side panel, placed immediately next to the side upright of the first side panel, is equipped with an opening whose shape and dimensions are adapted to the shape and dimensions of the catch and which is aligned in one plane with the catch. A spring is linked to the lever.

The catch may be wedge-shaped, which is preferable mainly when unfolding the transport container before its use for transportation of materials and goods. Preferable embodiment of the fixed axis uses a carrying shaft. The carrying shaft can be made of a screw bolt or worm.

Preferable structure of the lever includes a pair of opposing, preferably parallel, mutually offset walls connected by a pair of opposing, preferably parallel beveled walls, where one of the mutually offset walls is adjacent to the hollow 1 of the side upright and the catch is attached to the end of the outer side of the other wall of the pair of mutually offset walls.

Furthermore, it is preferable from the point of technology, manufacturing, and safety if the two opposing, preferably parallel beveled walls of the lever contain two opposing openings that serve for placement of the fixed axis of the lever. The wall of the side upright of the first side panel contains an opening or two openings for placement of the fixed axis, where the opening/openings are aligned in one plane with the openings placed within the parallel beveled walls of the lever. It is preferable from the point of technology, manufacturing, and safety if the lever inside the side upright of the first side panel revolves around the carrying shaft attached inside the openings in the opposing walls of the side upright of the first side panel. Revolving is facilitated by the opposing openings within the lever walls, providing suspension of the lever on the carrying shaft.

The inner side of the lever wall can contain a spur, laid out for attachment of a spring via a loop formed on the spring.

For increased safety and strength of the transport container, the side upright of the first side panel can be equipped with a safety spur and the side upright of the adjacent side panel is equipped with an opening, whose shape and dimensions are adapted to the shape and dimensions of the spur, for insertion of the spur. Insertion of the safety spur into the opening of the side upright of the adjacent side panel increases safety and strength of the transport panel in its unfolded state, prepared for storage of transported materials or goods.

The described folding transport container according to this invention represents an efficient and preferable solution for folding of empty transport containers. The advantages of the present invention include mostly:

- The lock-release mechanism does not exceed the outer dimensions of the transport container, which facilitates placement of containers immediately next to or behind each other, thereby reducing the space necessary for storage of the containers, also reducing the cost of container storage.
- Reduction of trouble incidence of transport containers, caused by jamming or breaking of the withdrawable pull rods, thereby reducing the cost of repair and maintenance of transport containers.
- Simple manipulation with no need for using considerable physical force.

EXAMPLES OF EMBODIMENTS

Figure 1:
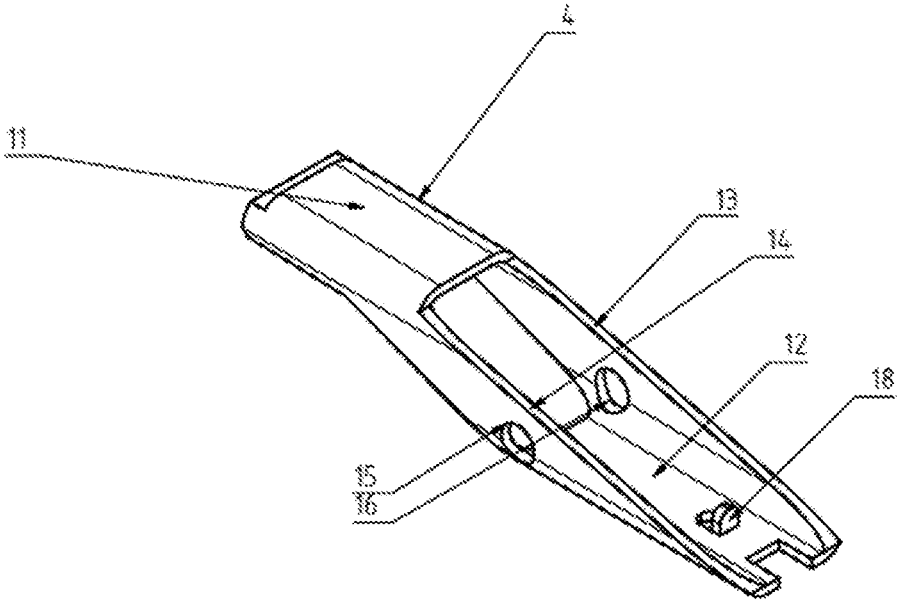
FIG. 1 represents the lever 4 with the two opposing openings 15, 16 for placement of the fixed axis 7 and with the spur 18 for attachment of a spring 6.
Figure 2:
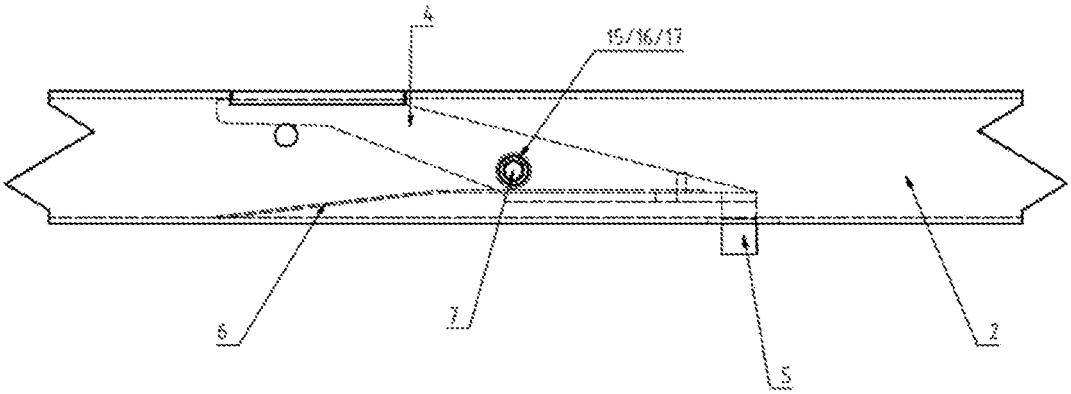
FIG. 2 represents a longitudinal section of the side upright 2 of the first side panel with the lever 4 with a catch 5 and a spring 6 when locked.
Figure 3:
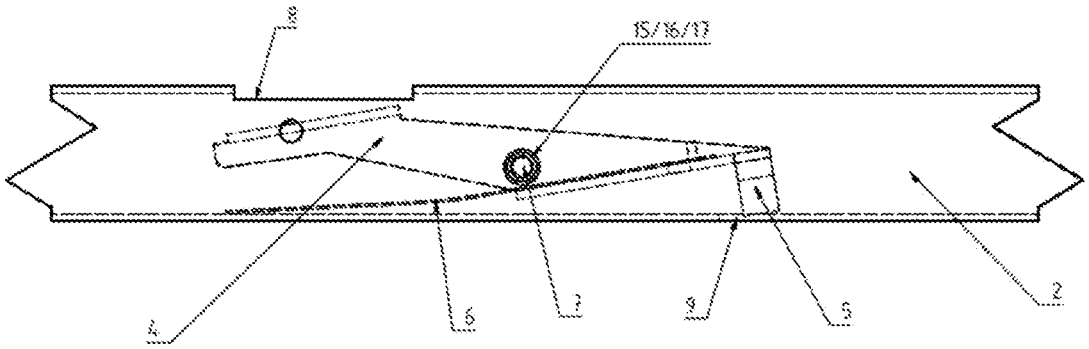
FIG. 3 represents the longitudinal section of the side upright 2 of the first side panel with the lever 4 with a catch 5 and a spring 6 when released.
Figure 4:
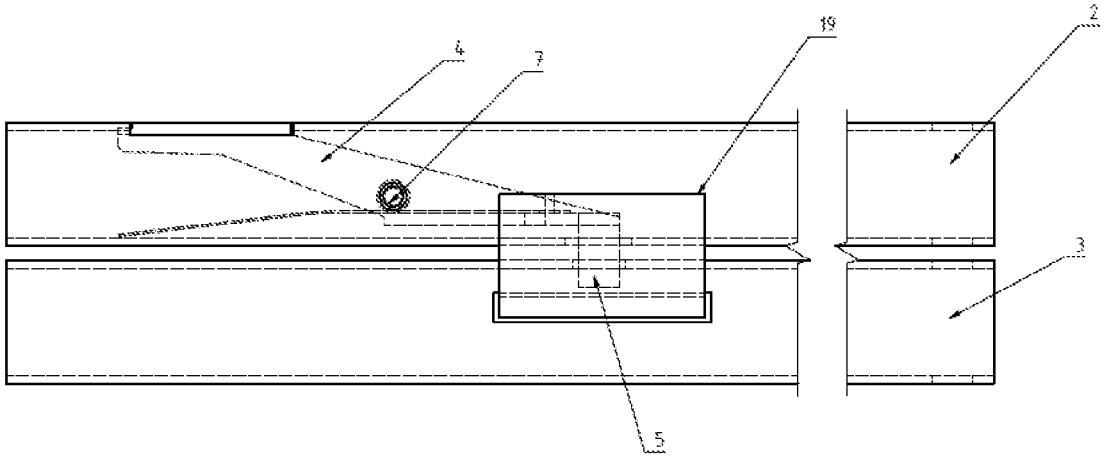
FIG. 4 represents the longitudinal section of the side upright 2 of the first side panel with the lever 4 with a catch 5 and a spring 6; and the side upright 3 of the adjacent side panel when locked. Further represents the safety spur 19 of the side upright 2 the first side panel, inserted in the opening 20 of the side upright 3 of the adjacent side panel.
Figure 5:
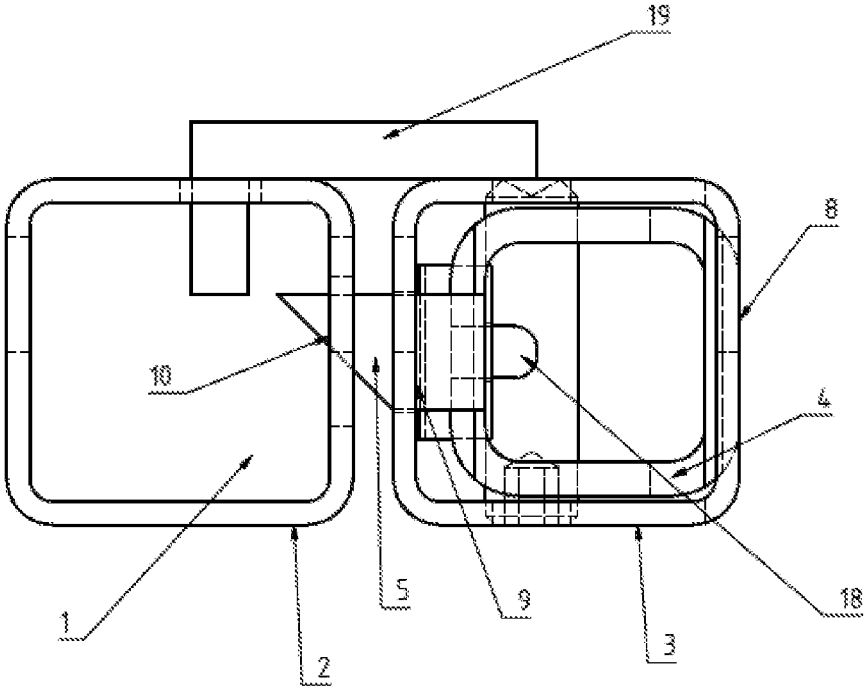
FIG. 5 represents the perpendicular cross section of the side upright 2 of the first side panel with the lever 4 with the wedge-shaped catch 5; and the side upright 3 of the adjacent side panel when locked. Further represents the safety spur 19 of the side upright 2 the first side panel, inserted in the opening 20 of the side upright 3 of the adjacent side panel.
Figure 6:
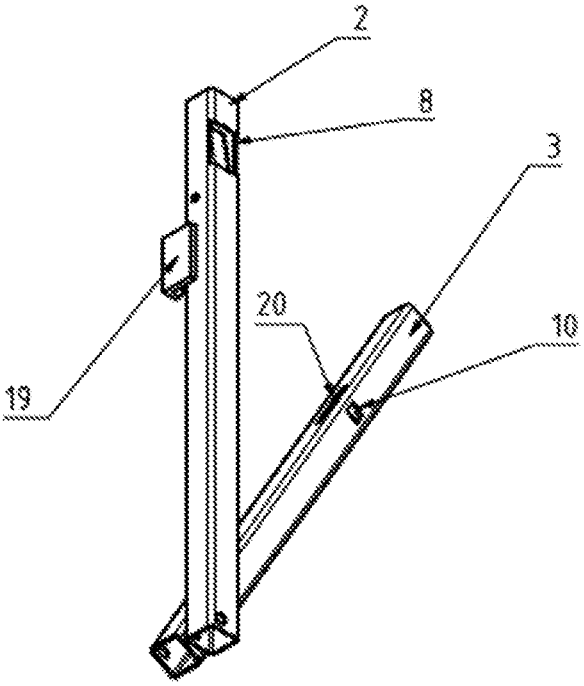
FIG. 6 represents the side upright 2 of the first side panel with the lever 4; and the side upright 3 of the adjacent side panel when released. Further represents the safety spur 19 of the side upright 2 the first side panel, inserted in the opening 20 of the side upright 3 of the adjacent side panel.

The invention is further disclosed in more detail in following non-limiting examples of embodiments.

Example No. 1

A folding transport container was produced with a lock-release mechanism 1 intended mainly for use in material transport. It includes the base and four side panels with side uprights, where these panels have pivot links with edges of the base. It contains two lock-release mechanisms 1, one placed inside the side upright 2 of the first (right-hand) side panel between the right-hand side panel and the front side panel, and the other one place inside the side upright 2 of the first (left-hand) side panel between the left-hand side panel and the rear side panel. The uprights of the right-hand side panel and the rear side panel as well as the uprights of the left-hand side panel and the front side panel are equipped with safety spurs and respective openings for insertion of the spurs for increased strength and safety of the transport container.

Both lock-release mechanisms 1 are identical. Each lock-release mechanism 1 includes a lever 4 with catch 5 and spring 6. The lever 4 is placed, in rotary fashion, inside the side upright 2 of the first side panel using a fixed axis 7 so that one end of the lever 4 is placed inside a hollow 1 8 of the side upright 2 of the first side panel, the other end of the lever 4 has fixed link to the catch 5, which is placed inside the hollow 2 9 of the side upright 2 of the first side panel, while the side upright 3 of the adjacent side panel is equipped with an opening 10, whose shape and dimensions are adapted to the shape and dimensions of the catch 5 and the lever 4 is linked to a spring 6 made of flexible steel. The lever 4 contains two parallel and mutually offset walls 11, 12 connected by two parallel beveled walls 13, 14, wherein the wall 11 is adjacent to the hollow 1 8 of the side upright 2 and the end of the outer side of the wall 12 contains a catch 5 attached by a fixed welded joint. The spring 6 is attached to the inner side of the wall 12 of the lever 4 by a fixed welded joint. The spring 6 is placed so that it ensures the return of the lever 4 into the locked position. The catch 5 is cuboid-shaped.

Two opposing parallel beveled walls 13, 14 of the lever 4 contain two opposing openings 15, 16 for placement of the fixed axis 7 and the wall of the upright 2 contains two openings 17 for placement of the fixed axis 7. The openings 17 are aligned in one plane with the openings 15, 16 in the opposing parallel beveled walls 13, 14 of the lever 4. The fixed axis 7 is a carrying shaft. The first opening 17 is equipped with a thread. The carrying shaft is created so that a screw bolt is screwed in through the openings 17 (threaded) and the openings 15, 16, biting into the other opening 17.

When the container is unfolded and it needs to be folded, upon pressing the outer side of the wall 11 of the lever 4 through the hollow 1 8 of the side upright 2, the lever 4 revolves around the fixed axis 7, which causes the catch 5 to fully insert from the hollow 2 9 of the side upright 2 inside the upright 2, allowing for separation of the side upright 3 of the adjacent side panel from the adjacently positioned side upright 2 of the first side panel, thereby folding the container by steps. During unfolding of the container, the outer side of the wall 11 of the lever 4 is pressed through the hollow 1 8 of the side upright 2, thereby causing the lever 4 to revolve around the fixed axis 7, which causes the catch 5 to fully insert from the hollow 2 9 of the side upright 2 into the side upright 2, thereby allowing for placement of the side upright 3 of the adjacent side panel next to the side upright 2 of the first side panel. After releasing the outer side of the wall 11 of the lever 4, the action of the spring 6 pushes the catch 5 out through the hollow 2 9 of the side upright 2 into the opening 10 of the side upright 3 of the adjacent side panel.

Example No. 2

A folding transport container was produced with a lock-release mechanism 1, like in the example No. 1; it differs by containing a spur 18 laid out on the inner side of the wall 12 with a spring 6 attached via a loop formed on the spring 6. The catch 5 is wedge-shaped. Such shape of the catch 5 ensures that during unfolding of the container, it is not necessary to press on the outer side of the wall 11 of the lever 4 because approaching of the adjacent side panel causes the side upright 3 of the adjacent side panel to press gradually the wedge-shaped catch 5 inside the side upright 2 of the first side panel.

For increased safety and strength, the side upright 2 of the first side panel is equipped with a safety spur 19 and the side upright 3 of the adjacent side panel is equipped with an opening 20, whose shape and dimensions are adapted to shape and dimensions of the spur 19, for insertion of the spur. Approaching the adjacent side panel, the safety spur 19 of the side upright 2 of the first side panel is inserted into the opening 20 within the side upright 3 of the adjacent side panel.

Example No. 3

A folding transport container was produced with a lock-release mechanism 1, like in the example No. 1; it differs by containing four lock-release mechanisms 1 located in the one upright 2 of the each side panel.

INDUSTRIAL APPLICABILITY

The industrial applicability of the folding transport container with lock-release mechanism according to this invention is obvious. The solution and in particular the embodiment of the lock-release mechanism may be used also for other purposes as transport purposes, e.g. storage containers and the like.

LISTING OF THE REFERENCE SIGNS

1 lock-release mechanism
2 side upright of the first side panel
3 side upright of the adjacent side panel
4 lever
5 catch
6 spring
7 fixed axis
8 hollow 1 of the side upright 2
9 hollow 2 of the side upright 2
10 opening of the side upright 3 of the adjacent side panel
11, 12 offset walls of the lever 4
13, 14 beveled walls of the lever 4
15, 16 opposing openings of the lever 4 for placement of the fixed axis 7
17 opening/openings in the wall of the upright 2 for placement of the fixed axis 7
18 spur for attachment of the spring 6
19 safety spur of the side upright 2 the first side panel
20 opening within the side upright 3 of the adjacent side panel for insertion of the spur 19

The invention claimed is:

1. A folding transport container configured for transport of materials, goods, and other cargo, comprising:

a base, and side panels with side uprights, wherein the side panels have pivot links with edges of the base and a lock-release mechanism, wherein the lock-release mechanism comprises a lever with a catch at one end thereof and a spring linked to the lever, wherein the lever is placed in rotary fashion with one of the side uprights of a first side panel using a fixed axis, wherein the lock-release mechanism is placed inside a side upright of the first side panel, wherein the side upright contains one hollow 1 and one hollow 2, wherein the lever is placed in rotary fashion inside the side upright of the first side panel using the fixed axis so that one end of the lever is placed within the hollow 1 of the side upright of the first side panel, while the other end of the lever has a fixed link to the catch that is placed inside the hollow 2 of the side upright of the first side panel, wherein a side upright of an adjacent side panel is equipped with an opening whose shape and dimensions are adapted to the shape and dimensions of the catch, and wherein the opening is positioned such, that when the container is unfolded, the catch catches into the opening.

2. The folding transport container according to claim 1, wherein the lever contains two opposing and mutually offset walls connected by two opposing beveled walls, wherein the two opposing and mutually offset walls comprise a first offset wall and a second offset wall, wherein the first offset wall of the lever is adjacent to the hollow 1 of the side upright and the catch is attached to an end of the outer side of the second offset wall of the lever.

3. The folding transport container according to claim 1, wherein the two opposing beveled walls of the lever contain two opposing openings for placement of the fixed axis.

4. The folding transport container according to claim 1, wherein a wall of the side upright contains one opening or two openings for placement of the fixed axis.

5. The folding transport container according to claim 1, wherein the catch is wedge-shaped.

6. The folding transport container according claim 2, wherein a spur is laid out on an inner side of the second offset wall of the lever, wherein the spring is attached to the spur via a loop formed on the spring.

7. The folding transport container according to claim 1, wherein the fixed axis is a carrying shaft.

8. The folding transport container according to claim 1, wherein the side upright of the first side panel is equipped with a safety spur and the side upright of the adjacent side panel adjacent to the first side panel is equipped with an opening opposite to the safety spur, and this opening is by shape and dimensions adapted to shape and dimensions of the spur, for insertion of the spur.

9. The folding transport container according to claim 1, wherein the spring is made of flexible steel.

* * * * *